US005499728A

United States Patent [19]

Rumsey

[11] Patent Number: 5,499,728

[45] Date of Patent: Mar. 19, 1996

[54] ELECTRICALLY OPERATED HOOK COUPLER WITH MANUAL OVERRIDE

[75] Inventor: Steven C. Rumsey, Greer, S.C.

[73] Assignee: Westinghouse Air Brake Company, Wilmerding, Pa.

[21] Appl. No.: 417,036

[22] Filed: Apr. 5, 1995

[51] Int. Cl.[6] ..... B61G 3/00

[52] U.S. Cl. ..... 213/101; 213/104; 213/216; 213/211

[58] Field of Search ..... 213/101, 105, 213/106, 159, 211, 216, 109, 75, 100 R, 104, 218

[56] References Cited

U.S. PATENT DOCUMENTS

| | | | |
|---|---|---|---|
| 130,238 | 8/1872 | Peabody | 213/101 |
| 348,954 | 9/1886 | Cornils | 213/105 |
| 395,391 | 1/1889 | Heath et al. | 213/101 |
| 481,907 | 8/1892 | Kindleberger | 213/101 |
| 500,309 | 6/1893 | White | 213/216 |
| 566,398 | 8/1896 | Hyde | 213/211 |
| 1,063,631 | 6/1913 | Westinghouse | 213/211 |
| 2,303,731 | 12/1942 | Ferri | 213/211 |
| 2,658,629 | 11/1953 | Pettit | 213/211 |
| 5,423,439 | 6/1995 | Richter | 213/111 |

*Primary Examiner*—Mark T. Le
*Attorney, Agent, or Firm*—James Ray & Associates

[57] ABSTRACT

An electrically operated hook-type coupler for attachment to an end of a railway transit vehicle for joining adjacent ends of a pair of such railway transit vehicles, in which a gathering core is provided at the forward end of a coupler head, with a hook member pivotally mounted within the gathering core, and being pivotal between a latch position and an unlatch position for engaging and disengaging a comparable hook member, and further including a spring to bias the hook member to the latch position. A driving device is also included within the gathering core for forcibly pivoting the hook member to the unlatch position to uncouple the hook member from any other hook member, while an electrically operated actuator is provided outside of the gathering core, which in response to appropriate signal, will activate the driving device to disengage the hook member. A lever arm is also provided to permit manual operation of the driving device to disengage the hook member. Manual operation does not require any preconditioning of the coupler and automatically resets for electric operation.

19 Claims, 3 Drawing Sheets

ELECTRICALLY OPERATED HOOK COUPLER WITH MANUAL OVERRIDE

FIELD OF THE INVENTION

The present invention relates, in general, to what is commonly known in the passenger transit-type vehicle art as hook-type couplers, as used to mechanically join adjacently disposed ends of a pair of railway passenger transit vehicles, such as electric trolleys and subway cars and, more particularly, this invention relates to a unique and improved electrically operated hook-type coupler which is constructed for compatibility with the pneumatically and hydraulically operated hook-type couplers of the prior art, and which optionally includes a manual override feature thereby permitting either electric or manual operation without any need to rebuild and reset the coupler after an uncoupling operation by either the electric or manual mode.

BACKGROUND OF THE INVENTION

It is generally well known, in the mass transit vehicle art, that most railway passenger transit vehicles, such as trolleys, subway cars, and the like, are capable of being independently operated as a single passenger transit vehicle, and are often operated as a single vehicle, particularly during times when passenger travel is at a low volume. It is also generally well known, in this art, that there are times when such transit vehicles will be operated as a unit of two, three, or even more such transit vehicles joined together, particularly, during times of relatively high volume passenger travel, such as encountered during the morning and evening "rush hours".

Accordingly, in order to permit the operation of such multiple car units, such transit vehicles must be provided with a coupling arrangement at their forward and rearward ends for selectively joining and un-joining the transit vehicles together as the need dictates.

Most railway passenger transit vehicles, of the prior art, have utilized simple "hook-type" couplers for joining the adjacent ends of one such vehicle to another. These couplers are either pneumatically or hydraulically operated to uncouple the coupler incident to the disjoining of such joined adjacent ends of such railway transit vehicles. That is to say, the coupler hooks are normally spring biased to a coupling position, so that when the coupler on one transit vehicle is brought into contact with the coupler on another transit vehicle, the coupler hooks will automatically engage each other to effect a coupling.

The pneumatic or hydraulic control incorporates the required responsive hardware that merely re-positions the engaged hooks so that the two transit vehicles are not coupled together, thereby permitting either one of the transit vehicles to be moved relative to the other.

A new generation of railway passenger transit vehicles are coming into use which are entirely electric, and are not provided with a source of fluid pressure, pneumatic or hydraulic. For use in such a new generation of transit vehicles, it was therefore essential that couplers be designed that are entirely electrically operated as no fluid pressure would be available to operate such a coupler. These newer electrically operated couplers are not of the hook-type, and are not, therefore, compatible with the prior art hook-type couplers.

If a particular transit authority were only to utilize the newer generation of all electric transit vehicles, no problem would normally be encountered. However, there are a number of transit authorities which have been forced to replace only a portion of their transit vehicle fleet, so that both the newer and older generations of transit vehicles have be utilized on the same lines. As a result, such authorities have been handicapped by the inability of being able to couple together any pair of transit vehicles not of the same generation.

In addition to the above noted difficulties, the newer electrically operated couplers cannot readily be operated manually from outside the vehicle, as is often desired by repair and service personnel in a repair or service shop, for example. For this reason, any effort to manually uncouple a pair of joined electric transit vehicles is not a simple operation, but requires hardware removal. After such hardware removal, the coupling device must be reconstructed and reset so that it will again be functional as a coupler.

As oftentimes happens, however, such a reconstruction and resetting operation is overlooked or forgotten, so that when the transit vehicle is returned to service, the coupling device will not function until it is in fact properly reconstructed and reset. Unfortunately, such reconstruction and resetting may require that the transit vehicle be returned to the repair or service shop before it can be placed into service in a multiple car unit.

SUMMARY OF THE INVENTION

The instant invention is predicated on my conception and development of a new and improved electrically operated hook-type coupler that is compatible with the pneumatically or hydraulically operated hook-type couplers of the prior art which are still in use. In this manner there is provided a coupler that will permit the newer generation, all-electric, transit vehicles to be joined to the older transit vehicles which have pneumatic or hydraulic hook-type couplers.

In addition to the above, the electrically operated hook-type coupler of this invention includes an optional manual override feature that permits one to quickly and easily set the hook coupler manually to either a latch or unlatch position, thereby permitting one to uncouple a pair of joined transit vehicles, as for example in a repair or service shop. The invented coupler is simple to operate from outside the vehicle and does not require the removal of any hardware. Since the manual override can easily position the hook coupler to either the latch or unlatch positions, there is obviously no need to reconstruct and reset the coupler after the adjacently joined ends of a pair of transit vehicles have been uncoupled manually. This feature not only saves time for repair and service personnel, but further eliminates the possibility that such a vehicle can be returned to service with an inoperable coupler.

In essence, this invention is directed to a hook-type coupler for attachment to an end of a railway transit vehicle for joining adjacent ends of a pair of such railway transit vehicles. Like the prior art hook-type couplers, the invented coupler includes a coupler head having a gathering core with a hook member pivotally mounted within the gathering core and being pivotal between a latch position and an unlatch position. The hook-type coupler of this invention is, of course, adapted to engage a second pivotally mounted hook member in a second hook-type coupler of compatible design when the gathering cores are brought into contact. The physical structures of each coupler must be compatible to the extent that a protruding end of each pivotal hook member will pass into the gathering core of the other coupler while such hook members are pivoted to such latch position, and the two hook members are spring biased so that they will engage each other to lock the two respective transit vehicles together. To that end, the coupler of this invention, like those of the prior art, must include a spring means within the gathering core having a biasing action for pivotally biasing the pivotally mounted hook member to such latch position. The coupler of this invention further includes a drive means, such as a cam, within the gathering core for overcoming the biasing action of the spring means to selectively pivot the hook member to the unlatch position, and an electrically operated actuator to selectively actuate the drive means to pivot the hook member to the unlatch position, to thereby uncouple the two hook members, and accordingly, uncouple the joined transit vehicles. More specifically, the actuator includes a piston rod, adapted to reciprocate an outward end thereof from an inactivated position to an activated position in response to an appropriate signal, while a linkage means interconnecting the outward end of the piston rod with the above-noted drive means serves to actuate the drive means, such that when the outward end of the piston rod is at the inactivated position, the biasing force of the spring means will bias the hook member into the latch position. When the outward end of the piston rod is reciprocated to the activated position, however, the drive means will be activated to overcome the biasing action of the spring means and pivot the hook member to the unlatch position.

As a preferred, optional feature, a manual control device can be included for manually activating the drive means. This can be achieved by incorporating a lever arm into the linkage. Preferably, the linkage itself will include a pivotal lever arm for manually rotating the drive means to pivot the hook member to the unlatch position, while the electrically operated activator is linked to the manual lever arm to automatically pivot the lever arm. Accordingly, the lever arm is such that it can be pivoted either manually or electrically.

OBJECTS OF THE INVENTION

Accordingly, it is a primary object of the present invention to provide a new and improved electrically operated hook-type coupler which is compatible with the pneumatically and hydraulically operated hook type couplers of the prior art.

Another primary object of this invention to provide an electrically operated hook-type coupler for use on electrically operated railway passenger transit vehicles which is compatible with the pneumatically and hydraulically operated hook-type couplers of the prior art, so that the newer electrically operated railway passenger transit vehicles can effectively be coupled to and uncoupled from the older railway passenger transit vehicles having hook-type couplers.

A further object of this invention to provide an electrically operated hook-type coupler for use on electrically operated railway passenger transit vehicles which includes a manual override which permits one to manually uncouple a pair of joined transit vehicles without the need to partially disassemble either of the joined couplers.

Still another object of this invention to provide an electrically operated hook-type coupler for use on electrically operated railway passenger transit vehicles which includes a manual override which permits one to manually position the hook member in either the latch or unlatch position, thereby rendering it most unlikely that repair or service personnel will return such a transit vehicle to service with an inoperable coupler.

In addition to the objects and advantages of the present invention described above, various other objects and advantages of the electrically operated hook coupler with a manual override will become more readily apparent to those persons skilled in the transit vehicle coupling art after a full reading of the following detailed description, particularly, when such description is read in conjunction with the attached drawing Figures as described below.

DESCRIPTION OF THE PRESENTLY PREFERRED EMBODIMENT OF THE INVENTION

Figure 1:
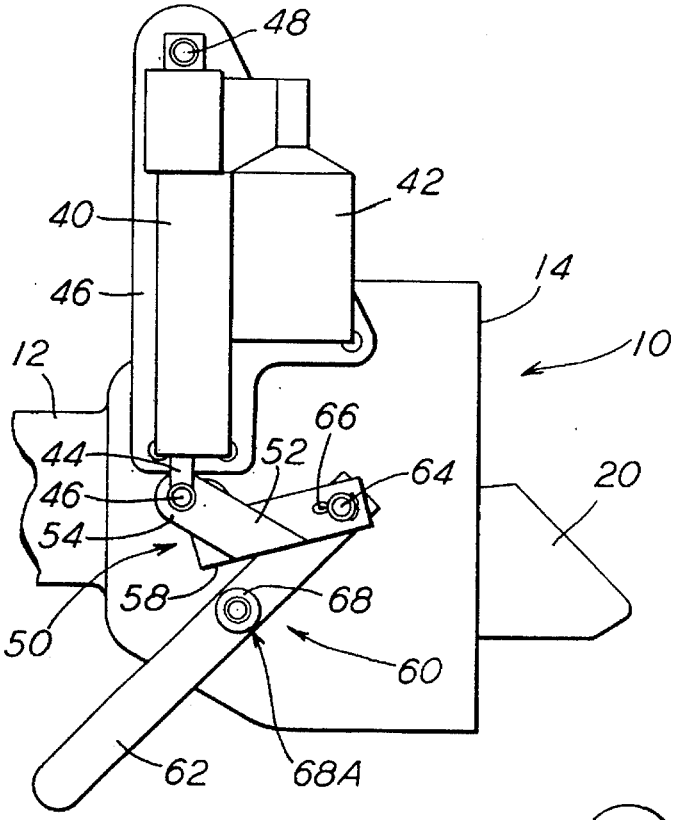
FIG. 1 is a plan view of a coupler head produced in accordance with a presently preferred embodiment of this invention with all uncoupling components being illustrated in the inactivated position thereby rendering the coupler head as ready to be coupled with another coupler head of a comparable mating design.

Prior to proceeding with a detailed description of the subject invention, it is noted that for the sake of clarity, identical components which have identical functions have been identified with identical reference numerals throughout the several views of the attached drawings.

Reference to FIGS. 1–6 will illustrate a presently preferred embodiment of this invention, namely, an electrically operated hook-type coupler for attachment to an end of a railway transit vehicle for joining together adjacently disposed ends of a pair of such railway transit vehicles.

The inventive coupler essentially comprises a coupler head, generally designated 10, having a shank portion 12 for connecting the coupler head 10 to a frame member (not shown) of a transit vehicle (not shown). As shown, the coupler head 10 includes a gathering core 14, which in essence comprises a generally rectangular cavity formed in a flat, forward face 16 of the coupler head 10.

A hook member 20 is pivotally mounted for partial rotation on axle pin 22 within gathering core 14 and is suitably disposed to one side of gathering core 14, so that the exposed portion of a comparable hook member 20A disposed on another compatible coupler head 10A can be inserted into the gathering core 14 to engage hook member 20. In a like manner and at the same time, the exposed portion of such hook member 20 will be inserted within gathering core 14A so that hook members 10 and 10A engage each other to effect the desired coupling.

Figure 4:
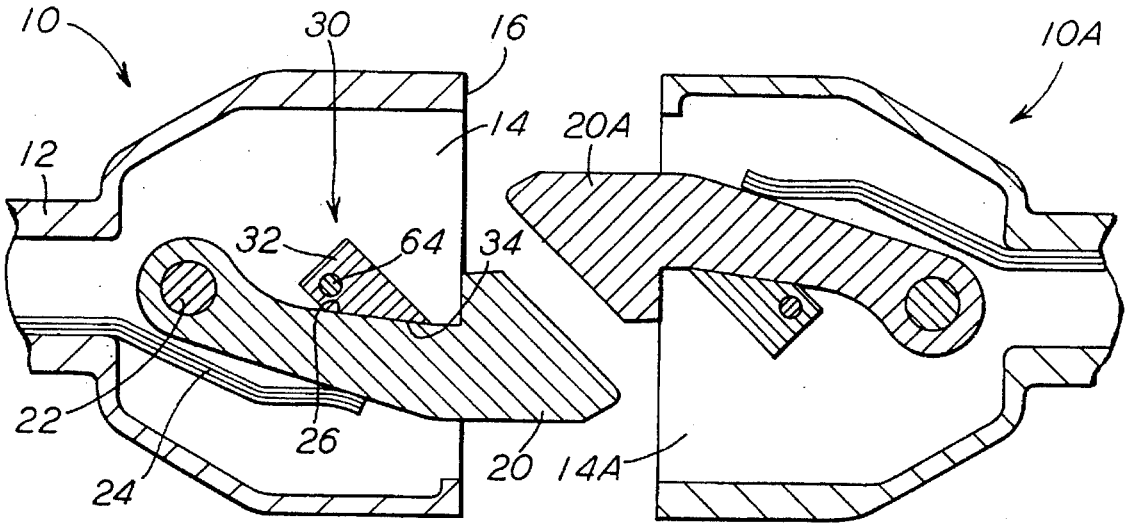
FIG. 4 is a plan view of a pair of coupler heads, both being shown in cross-section so the components inside the gathering core can be seen, with the coupler heads adjacently disposed as they would be positioned just prior to a coupling operation with both hook members in the latch position as necessary to be coupled together.
Figure 5:
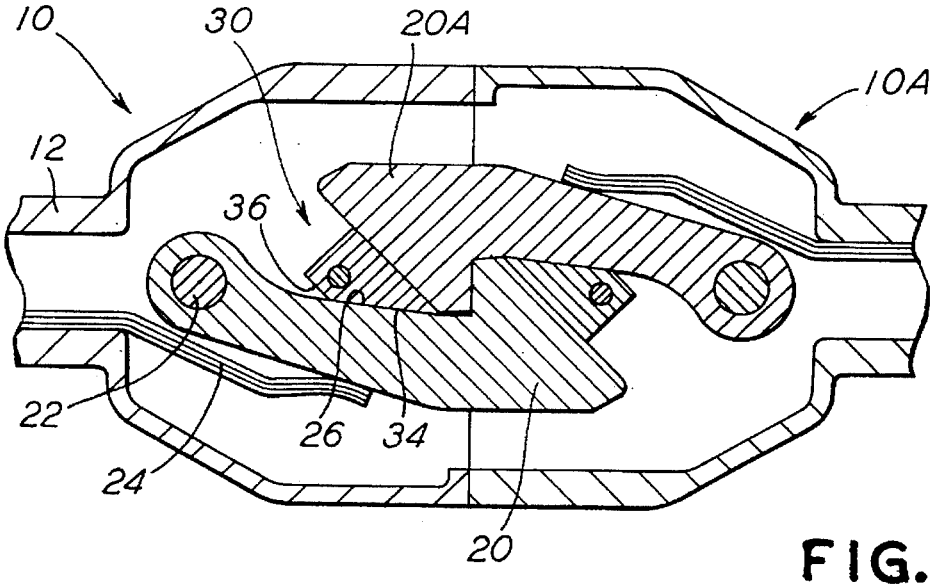
FIG. 5 is substantially the same as FIG. 4, except that it illustrates the coupler heads joined together with the hook members properly engaged to lock the coupler heads together.
Figure 6:
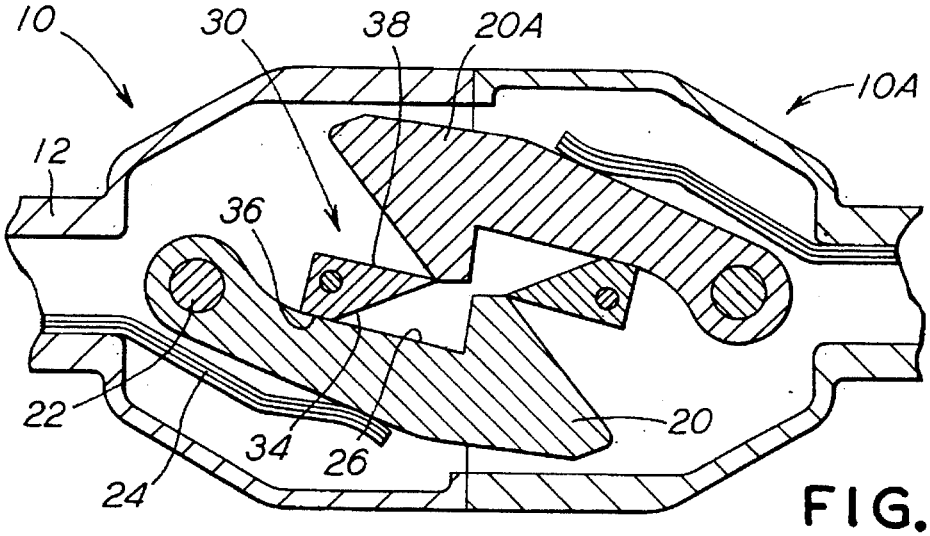
FIG. 6 is substantially the same as FIG. 5 but showing the components inside the gathering core as activated to effect an uncoupling operation whether affected by an automatic electrical means or by manual means.

As can be seen by contrasting FIGS. 4 and 5 with FIG. 6, hook member 20, as pivotally mounted on pin 22, is pivotal between a latch position as illustrated in FIGS. 4 and 5, and an unlatch position as illustrated in FIG. 6. A spring means 24, such as a composite multiple leaf spring as shown, is also secured within gathering core 14 for purposes of biasing hook member 20 to the latch position as illustrated in FIGS. 4 and 5, whereby the flat surface 26 of hook member 20 is biased against an elongated, flat, side surface 34 on cam 32.

Accordingly, also mounted within such gathering core 12 is a drive means, generally designated 30. Such drive means 30 is illustrated as a partially rotatable cam 32 for forcibly pivoting the hook member 20 to the unlatch position as can best be seen in FIG. 6, thereby overcoming the biasing action of spring means 24 and moving hook member 20 to the unlatch position where it will not and cannot be latched to an adjacent hook member 20A.

Also included in the hook coupler of the present invention is an electrically operated actuator 40. Actuator 40 functions to electrically operate the drive means 30; e.g., partially rotate cam 32, to selectively pivot hook member 20 to the unlatch position, permitting the hook members 20 and 20A be become unlatched, thereby effecting an uncoupling of the joined coupler heads 10 and 10A, as well as an uncoupling of the transit vehicles (not shown) to which the couplers are attached.

As further shown, plate member 46 is rigidly attached to the outer surface of coupler head 19, while actuator 40 is pivotally attached to plate member 46 at pin 48, which thereby permits a partial, pivotal reaction of actuator 40 as necessary to permit it to function, as described below.

Figure 2:
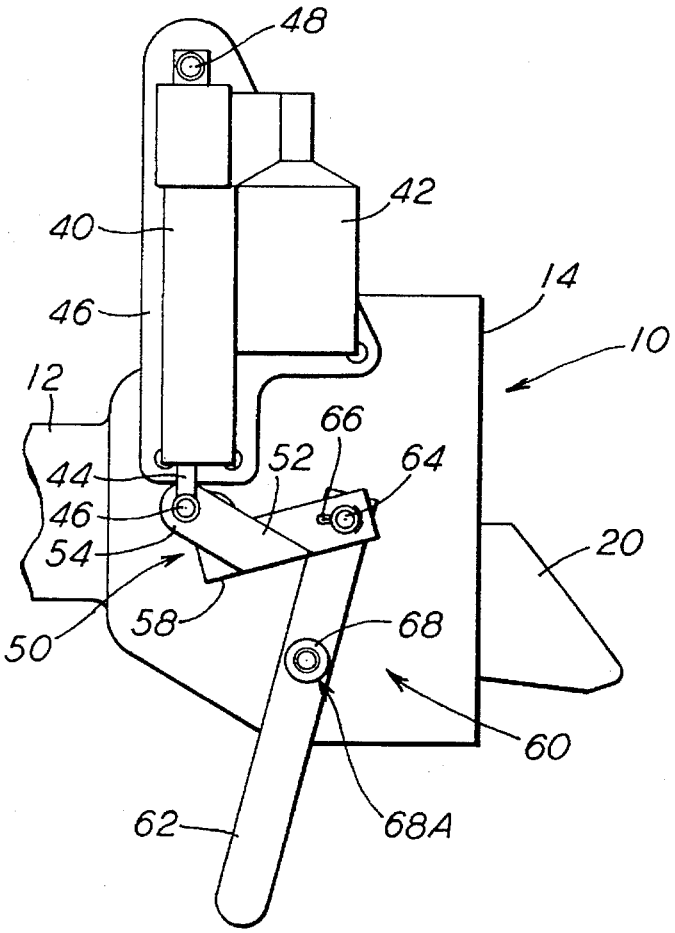
FIG. 2 is another plan view of the coupler head illustrated in FIG. 1, but showing the manual uncoupling components as manually activated to effect an uncoupling operation.
Figure 3:
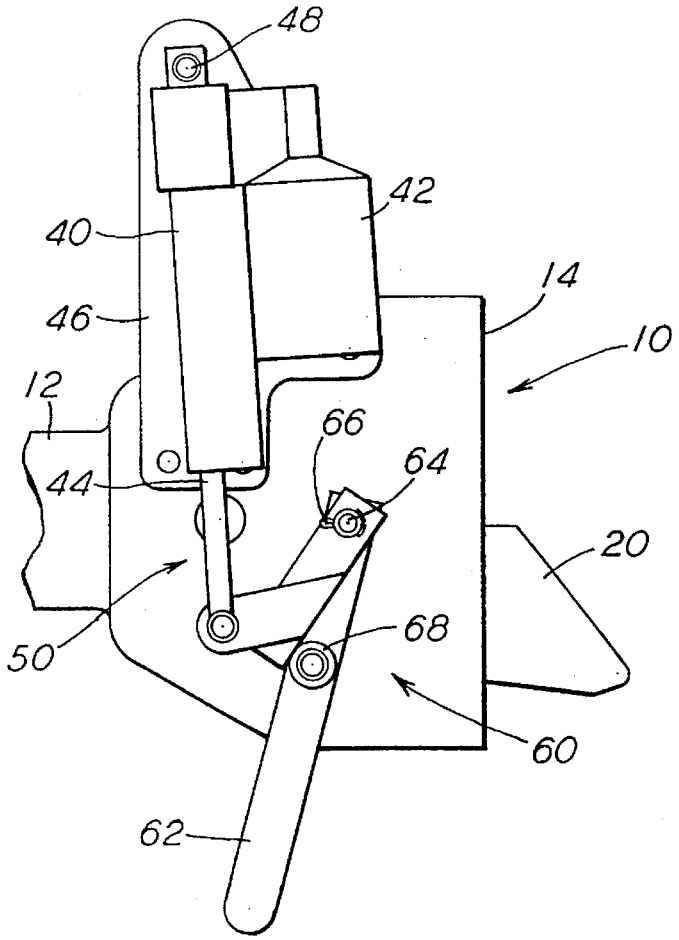
FIG. 3 is another plan view of the coupler head illustrated in FIGS. 1 and 2, but showing the automatic uncoupling components as automatically activated to effect an uncoupling operation.

In the presently preferred embodiment illustrated in FIGS. 1–3, actuator 40 comprises a conventional electric motor driven actuator, whereby a motor 42, in response to a suitable electric current, is adapted to reciprocate a piston rod 44 and, accordingly, reciprocate an outward end 46 of piston rod 44, from an inactivated position, illustrated in FIG. 1, to an activated position, illustrated in FIG. 3.

A suitable linkage means, generally designated 50, and further described below in more detail, is provided to interconnect the outward end 46 of piston rod 44 with the drive means 30, such that when the outward end 46 of piston rod 44 is at the inactivated position, the biasing force of the spring means 24 will bias hook member 20 into the latch position as shown in FIGS. 4 and 5. Conversely, when actuator 40 moves the outward end 46 of piston rod 44 to the activated position, the drive means 30 will overcome the biasing action of the spring means 24 and pivot hook member 20 to the unlatch position.

With regard to the cam 32 as illustrated, and once again contrasting FIGS. 4 and 5 with FIG. 6, the action of cam 30 can be seen. Specifically, in the latch position (FIG. 4), cam 30 is rotatably positioned so that flat surface 26 on hook member 20 is biased against an elongated, flat, side surface 34 on cam 32. For cam 32 to pivot hook member 20 to the unlatch position (FIG. 6), cam 32 must be rotated counter-clockwise so that the cam. 30 will force the hook member 20 downwardly, against the biasing action of spring means 24 until a second flat surface 36, on cam 30, engages flat surface 26 on hook member 20. As shown in FIG. 6, when both hook members 20 and 20A are pivoted to the unlatch position, they no longer engage each other and, accordingly, the coupler heads 10 and 10A are no longer joined together, which thereby permits one transit vehicle to be driven away from the other. While it is not essential that surface 36 on cam 32 be flat, the fact that it is flat will make it serve as a detent to at least temporarily hold hook member 20 in the unlatch position without the need to maintain an applied force on cam 32.

When the coupler heads 10 and 10A are withdrawn from each other so that the two transit vehicles (not shown) are no longer joined together the actuator 40 can be reversed, thereby returning the outward end 46 of piston rod 44 to the inactive position which will in turn rotate cam 32 as necessary to permit spring means 24 to pivotally bias hook member 20 back to the latch position.

If, for some reason, cam 32 becomes stuck in the rotational position where hook member 20 is pivoted to the unlatch position, it can be seen in FIG. 6 that any effort to again join together a pair of coupler heads 10 and 10A, will cause hook member 10A to contact flat surface 38 on cam 32, thereby forcing rotation of such cam 32 as necessary to disengage hook member 20 from the unlatch position and allow it to return to the latch position by the force of spring means 24.

The embodiment of the invention as illustrated in FIGS. 1–3 further includes a manual override which permits one to manually position the hook member 10 in either the latched or unlatched position, thereby providing repair or service personnel with an easy means to manually uncouple a pair of joined transit vehicles without any significant risk that either transit vehicle will be returned to service with an inoperable coupler.

As shown in FIGS. 1–3, the manual override, generally designated 60, comprises a lever arm 62 that is pivotally secured to pin 64 which rotatably extends through the upper surface of coupler housing 10 and to which cam 32 is pivotally secured. Both the lever arm 62 and cam 32 are rigidly secured by bolt 68A and any pivotal movement of lever arm 62 will cause a comparable partial rotational movement of cam 32. Accordingly, a counter-clockwise pivotal movement of lever arm 62; i.e., movement from the position as depicted in FIG. 1 to that depicted in FIG. 2, will cause at least partial rotation of cam 32 from its position as depicted in FIG. 4 to that depicted in FIG. 6. As can be further seen, this pivotal movement of lever arm 62 will cause hook member 20 to be pivoted from the latch position to the unlatch position.

With the manual override 60 as has been described above, the linkage 50 will now be described in greater detail. Specifically, linkage 50 comprises an angled pivot bar 52, a first end 54 of which is pivotally pinned to the outer end 46 of piston rod 44 and a second end 56 is pivotally pinned to pin 64 over the upper surface of lever arm 62 and held in place by a cotter pin 66. Between the first end 54 and the second end 56, an engaging means such as pushing edge 58 is provided. Pushing edge 58 is adapted to engage a shoulder 68 on lever arm 62 when pivot bar 52 is pivoted as a result of the outer end 46 of piston rod 44 advancing to the active position.

Accordingly, when the actuator 40 is activated to move outer end 46 of piston rod 44 to the active position, as illustrated in FIG. 2, pushing edge 58 on angled pivot bar 52 will engage the shoulder 68 on lever arm 62, thereby causing lever arm 62 to be electrically pivoted as necessary to partially rotate cam 32 and thereby pivot hook member 20 to the unlatch position. With this particular type of arrangement, actuator 40 actually drives the manual override 60; i.e., pivots lever arm 62 to do automatically what can be done manually.

It should be apparent that if the apparatus did not include the manual override 60, or lever arm 62, that pivotal bar 52 could be rigidly secured to pin 64 so that the motion of outer end 46 of the piston rod 44 would directly cause partial rotation of pin 64 and, accordingly, cam 32. While in a like manner, it would also be possible to rigidly secure pivot bar 52 to pin 64 even though the lever arm 64 is included, and thereby eliminate the need for pushing edge 58. It should be apparent, however, that this would make manual operation of lever arm 62 more difficult, as any manual pivotal effort of lever arm 62 would then have to reciprocate such piston rod 44 and overcome any resistance in the actuator 40 in order for such manual reciprocation to occur. For the preferred embodiment as illustrated, therefore, push bar 52 should be free to rotate on pin 64, while obviously, lever arm 62 should not.

Figure 7:
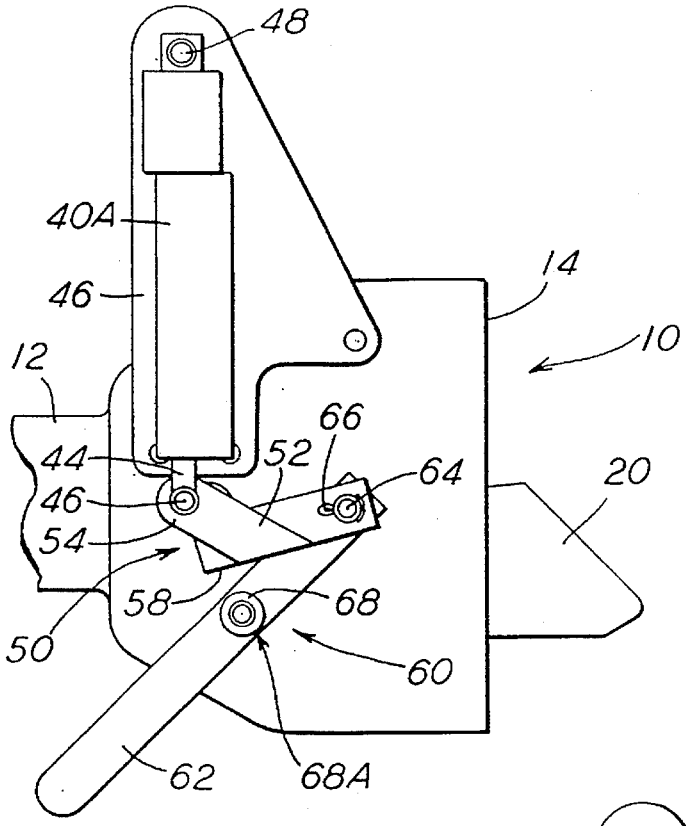
FIG. 7 is identical to FIG. 1 except that it illustrates a solenoid as an activator instead of an electric motor driven activator as illustrated in FIGS. 1–3.

Having described in detail a presently preferred embodiment of this invention, it should be apparent that other embodiments could be utilized and various modifications incorporated therein without departing from the spirit of the invention. For example, reference to FIG. 7 will illustrate an identical coupler head arrangement, but utilizing a solenoid 40A as an actuator. It should also be quite apparent that the drive means 30, and particularly the cam 32 could take different forms. While an irregular, circular form typical of most cams could be developed, the flat side surfaces on can 32 provide end point detents, as described above which are advantageous. Clearly, other modifications could be included and other embodiments designed without departing from the either the spirit or the scope of the appended claims.

I claim:

1. An electrically operated hook-type coupler for attachment to an end of a railway transit vehicle for joining adjacent ends of a pair of such railway transit vehicles, said hook-type coupler comprising:

(a) a coupler head having a gathering core;

(b) a hook member pivotally mounted within said gathering core, and being pivotal between a latch position and an unlatch position, and adapted to engage a second pivotally mounted hook member in a second hook-type coupler of compatible design, when said gathering core is brought into contact with a second gathering core on said second hook-type coupler of compatible design, and both of said pivotally mounted hook members are pivoted to said latch position;

(c) a spring means within said gathering core having a biasing action for pivotally biasing said pivotally mounted hook member to said latch position;

(d) a drive means within said gathering core for forcibly pivoting said hook member to said unlatch position, thereby overcoming said biasing action of said spring means;

(e) an electrically operated actuator disposed outside of said gathering core having a piston rod, adapted for reciprocal motion in response to an applied electrical current;

(f) a linkage means disposed outside of said gathering core interconnecting said piston rod with said drive means, such that said reciprocal motion of said piston rod will activate said drive means to reciprocate said hook member between said latch position and said unlatch position; and (g) manual actuating lever means incorporated into said linkage means adapted to permit manual operation of said linkage means to manually activate said drive means within said gathering core for pivoting said hook member to said unlatch position.

2. An electrically operated hook-type coupler, according to claim 1, in which said actuator includes an electric motor for electrically reciprocating said piston rod.

3. An electrically operated hook-type coupler, according to claim 1, in which said actuator includes a solenoid for electrically reciprocating said piston rod.

4. An electrically operated hook-type coupler, according to claim 1, in which said spring means comprises a composite of leaf springs.

5. An electrically operated hook-type coupler, according to claim 1, in which said drive means comprises a partially rotatable cam member adapted to pivot said hook member to said unlatch position upon partial rotation of said cam.

6. An electrically operated hook-type coupler, according to claim 5, in which said manual control device for activating said drive means comprises a lever arm pivotally mounted to an outer surface of said coupler head and connected to said cam member such that a partial pivotal rotation of said lever arm will partially rotate said cam member sufficient to pivot said hook member to said unlatch position.

7. An electrically operated hook-type coupler, according to claim 6, in which said cam member is provided with a detent means adapted to at least temporarily hold said hook member in said unlatch position.

8. An electrically operated hook-type coupler, according to claim 7, in which said detent means comprises a partial flat surface on said cam member adapted to engage a flat surface on said hook member when said cam member has pivoted said hook member to said unlatch position.

9. An electrically operated hook-type coupler for attachment to an end of a railway passenger transit vehicle for joining adjacently disposed ends of a pair of such railway passenger transit vehicles, said electrically operated hook-type coupler comprising:

(a) a coupler head having a gathering core;

(b) a hook member pivotally mounted within said gathering core and being pivotal between a latch position and an unlatch position and adapted to engage a second pivotally mounted hook member in a second hook-type coupler of compatible design when said gathering core is brought into contact with a second gathering core on said second hook-type coupler of compatible design and both of said pivotally mounted hook members are pivoted to said latch position;

(c) a spring means disposed within said gathering core having a biasing action for pivotally biasing said pivotally mounted hook member to said latch position;

(d) a rotatable cam member disposed within said gathering core for forcibly pivoting said hook member to said unlatch position and thereby overcome said biasing action of said spring means;

(e) a pivotal lever arm disposed outside of said coupler head and secured to said rotatable cam member within said gathering core for manually rotating said rotatable cam member to forcibly pivot said hook member to said unlatch position;

(f) an electrically operated actuator having a piston rod adapted to reciprocate an outward end of said piston rod from an inactivated position to an activated position in response to an appropriate signal;

(g) a linkage means interconnecting said outward end of said piston rod with said pivotal lever arm in a manner such that when said outward end of said piston rod is reciprocated to said activated position said pivotal lever arm will rotate said rotatable cam member to forcibly pivot said hook member to said unlatch position;

10. An electrically operated hook-type coupler, according to claim 9, in which said pivotal lever arm and said rotatable cam member are interconnected by a pin member rotatably extending through a wall member of said coupler head.

11. An electrically operated hook-type coupler, according to claim 10, in which said linkage means comprises a bar member, a first end of said bar member is pivotally connected to said outward end of said piston rod and a second end is rigidly connected to said pin member such that partial pivotal rotation of said bar member will cause partial rotational movement of said pin member and said rotatable cam member.

12. An electrically operated hook-type coupler, according to claim 10, in which said linkage means comprises a bar member, a first end of said bar member is pivotally connected to said outward end of said piston rod and a second end is pivotally connected to said pin member and having engaging means thereon adapted to engage said pivotal lever arm in a manner such that a partial pivotal rotation of said bar member will cause said engaging means to partially pivot said pivotal lever arm as necessary to rotate said rotatable cam member and pivot said hook member to said unlatch position.

13. An electrically operated hook-type coupler, according to claim 9, in which said rotatable cam member is provided with a detent means adapted to at least temporarily hold said hook member is said unlatch position.

14. An electrically operated hook-type coupler, according to claim 13, in which said detent means comprises at least a partially flat surface disposed on said cam member and adapted to engage a flat surface on said hook member when said cam member has pivoted said hook member to said unlatch position.

15. An electrically operated hook-type coupler, according to claim 14, in which said cam member is provided with an engagement surface adapted to be engaged by said second pivotally mounted hook member in said second hook-type coupler when said gathering core is brought into contact with said second gathering core on said second hook-type coupler and when said detent means is holding said hook member in said unlatch position such that engagement by said second hook member will disengage said detent means allowing said spring means to bias said hook member to said latch position.

16. An electrically operated hook-type coupler, according to claim 9, in which said actuator includes an electric motor for electrically reciprocating said piston rod.

17. An electrically operated hook-type coupler, according to claim 9, in which said actuator includes a solenoid for electrically reciprocating said piston rod.

18. An electrically operated hook-type coupler, according to claim 9, in which said spring means comprises a multiple leaf spring.

19. An electrically operated hook-type coupler, according to claim 9, in which said electrically operated actuator is pivotally mounted to said coupler head as necessary to permit a pivotal response of said actuator when said outward end of said piston rod activates said linkage means.

* * * * *

UNITED STATES PATENT AND TRADEMARK OFFICE

CERTIFICATE OF CORRECTION

PATENT NO. : 5,499,728

DATED : March 19, 1996

INVENTOR(S) : Steven C. Rumsey

It is certified that error appears in the above-indentified patent and that said Letters Patent is hereby corrected as shown below:

Column 5, line 30, delete "be" and insert --to--;

column 5, line 65, after cam. delete the "period".

Column 7, line 30, delete "can" and insert --cam--.

Column 9, line 33, delete "is" and insert --in--.

Signed and Sealed this

Thirtieth Day of July, 1996

*Attest:*

*Attesting Officer*

BRUCE LEHMAN

*Commissioner of Patents and Trademarks*